United States Patent [19]

Loudermilk, Jr.

[11] 4,347,967

[45] Sep. 7, 1982

[54] MULTICOMPARTMENT FOLDING CARTON

[76] Inventor: Jake Loudermilk, Jr., 1200 W. North Carrier Pkwy., Grand Prairie, Tex. 75050

[21] Appl. No.: 228,310

[22] Filed: Jan. 26, 1981

[51] Int. Cl.[3] ..... B65D 5/48

[52] U.S. Cl. ..... 229/27; 229/15

[58] Field of Search ..... 229/27, 28 R, 28 BC, 229/29 E, 15, 29 D, 41 B

[56] References Cited

U.S. PATENT DOCUMENTS

| | | | |
|---|---|---|---|
| 2,599,800 | 6/1952 | Wolfe | 229/39 |
| 3,456,862 | 7/1969 | Stegner | 229/27 |
| 3,941,302 | 3/1976 | Tyrseck | 229/27 |
| 4,197,979 | 4/1980 | Dutcher | 229/27 |
| 4,211,359 | 7/1980 | Chaffin | 229/28 |

FOREIGN PATENT DOCUMENTS 1553668 10/1979 United Kingdom .

*Primary Examiner*—Joseph Man-Fu Moy

[57] ABSTRACT

A multicompartment folding carton constructed from an integral blank. The carton includes four side walls and is partitioned into six cells by flaps attached to the bottom edges of the side walls and folded to form the bottom of the carton and dividers in the carton. A locking feature is provided to secure the dividers and to tightly lock the bottom of the carton.

7 Claims, 10 Drawing Figures

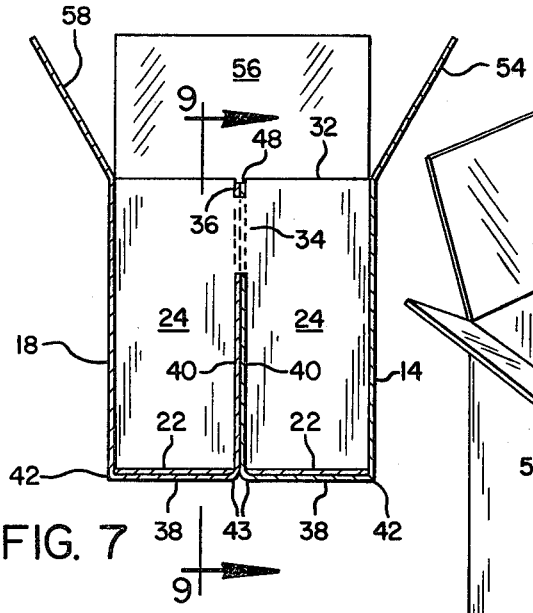
FIG. 7
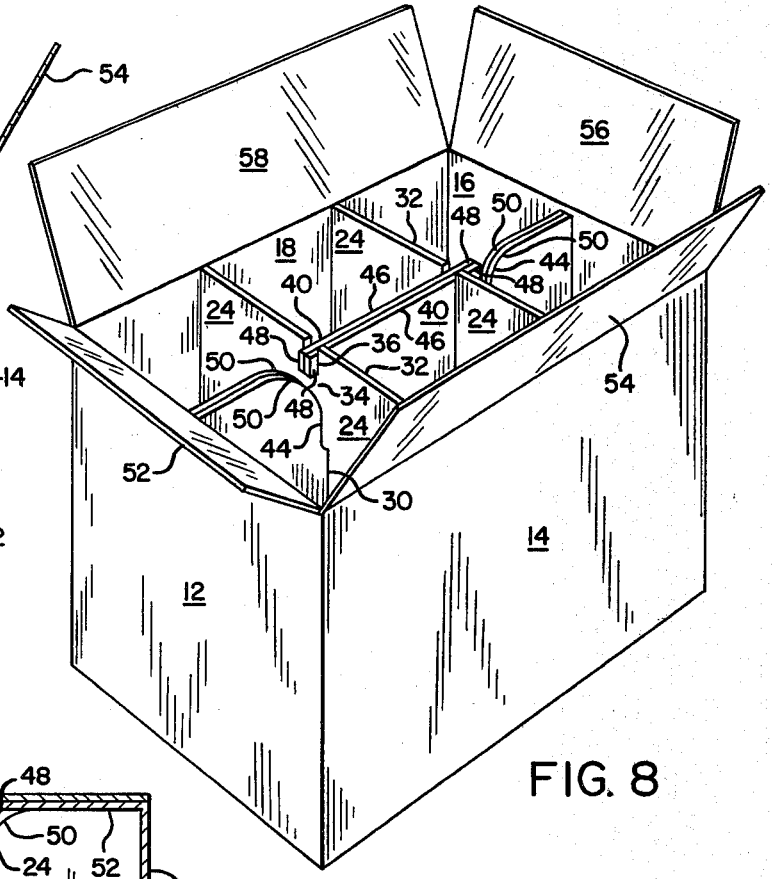
FIG. 8
FIG. 9
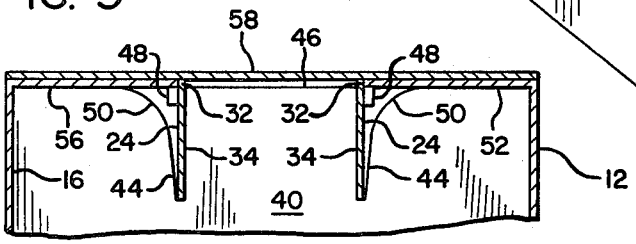
FIG. 10
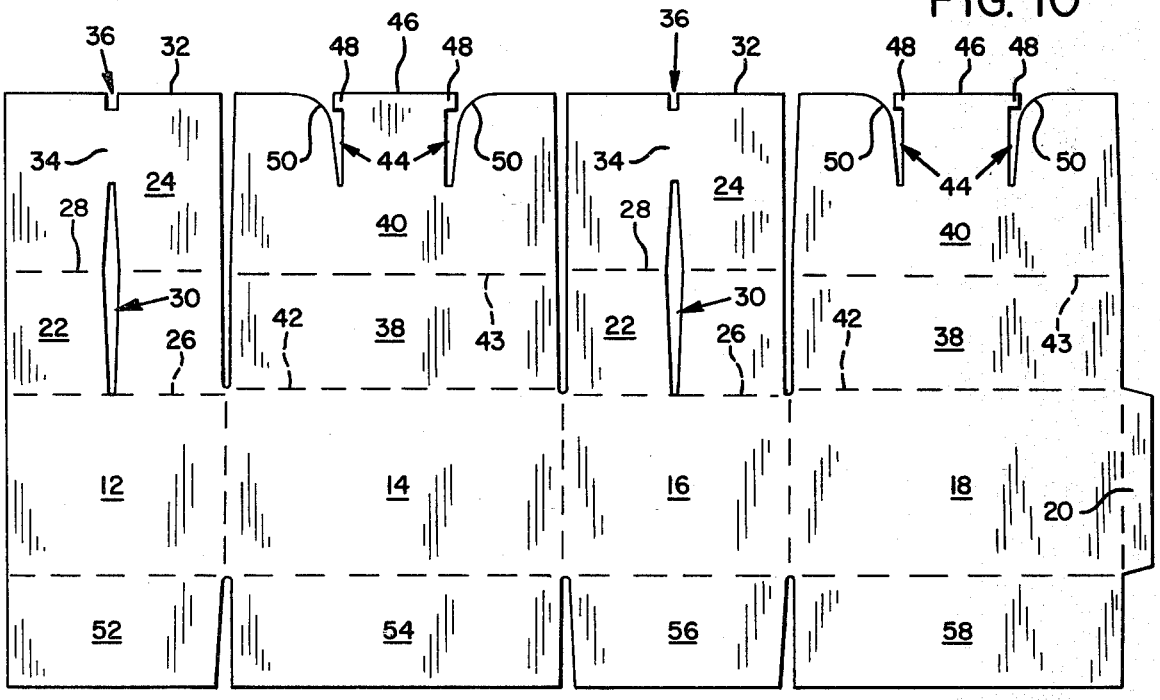

MULTICOMPARTMENT FOLDING CARTON

BACKGROUND OF THE INVENTION

This invention relates to a container or carton having internal partitions, and more particularly to such a carton which is self-locking and self-partitioning and wherein the side walls and the top, bottom, and internal dividers are formed from an integral blank.

It is often found necessary to provide cartons made, for example, of corrugated board or other sheet materials, and internally partitioned to provide packaging for breakable articles such as bottles, jars, or glasses. In many known cartons of this kind, the internal dividers are separate from the container itself, a feature which necessarily causes added expense in labor and materials. It also leads to the production of a carton of reduced stability and strength.

Heretofore, several cartons of the class of the present invention, having integral dividers, have been proposed. However it is a common failing of nearly all such cartons that the dividers, in order to interact in the required manner in the erection of the carton from the flat to the open condition, are not full length and only incompletely fill the planes between the separate cells. Locating divider material between the articles by providing full length dividers is particularly important when the articles do not have upright sides, but instead are tapered or bellied, as is frequently the case with glass bottles and the like.

Another problem with such prior art containers is their inability to tightly seal and lock the bottom of the carton and to secure it against opening under the stresses caused by the heavy weight of the carton contents. Further, many prior art cartons require the use of strapping tapes or adhesives in order to lock together the carton components to achieve the necessary stability and stacking strength.

Accordingly, it is the general object of the present invention to provide a multi-compartment carton assembled from an integral blank.

Another object is to provide a carton having dividers extending the entire depth of the carton.

Yet another object is to provide a locking feature which tightly secures the bottom of the carton.

A further object is to provide a carton which is easy to assemble without need for the use of adhesives or strapping tape.

A still further object is to provide a container having increased stacking strength.

These and other objects and advantages of the present invention and the manner in which they are achieved will be made apparent in the following specification and claims.

SUMMARY OF THE INVENTION

In its basic concept the present invention is a substantially rectangular, multicompart carton having four side walls, and attached to the bottom edge of the side walls four flaps which fold into the carton, thus forming the bottom and dividing the carton into a plurality of cells. Two similar opposed flaps, each having a slit therein, fold into the carton. The other two similar opposed flaps next fold into the carton overlapping the first two flaps, and extend into the slits in the first flaps. A locking feature is provided to secure the flaps forming the dividers in the carton and to lock and tightly secure the bottom of the carton.

BRIEF DESCRIPTION OF THE DRAWINGS

FIG. 7 is a transverse section taken along the line 7—7 of FIG. 6.

FIG. 8 is a top perspective view of the carton of the present invention showing the partitions folded into completed or set-up form.

FIG. 9 is a fragmentary section taken along the line 9—9 of FIG. 7.

FIG. 10 is a plan view of the blank from which the container of the present invention is formed.

DESCRIPTION OF THE PREFERRED EMBODIMENT

Figure 1:
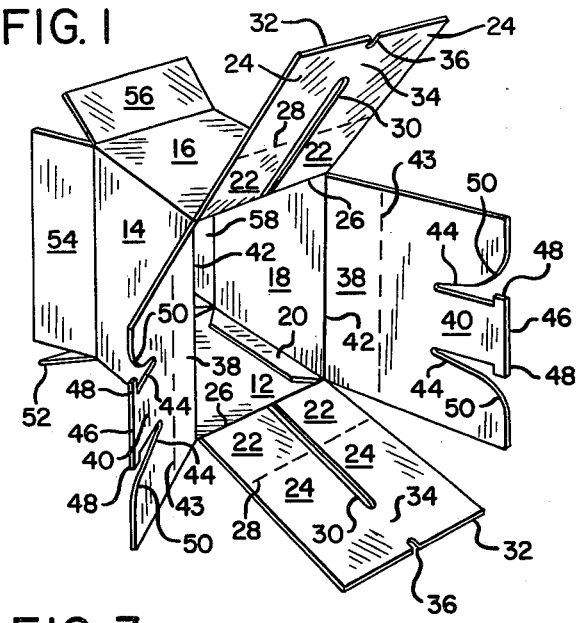
FIG. 1 is a top perspective view of the carton of the present invention lying on its side with its flaps extended.

As shown in FIG. 10, in blank or completely unfolded form, the container or carton of the present invention comprises four articulated side walls 12, 14, 16 and 18. When folded and one end of the side walls connected to the other end of the side walls by the lapping attachment of a glue flap 20 the side walls form a tubular body which may be folded flat for shipping, or squared to form a substantially rectangular box.

Attached to two non-adjacent side walls (or opposite side walls in the cartons's squared condition) and preferably short side walls 12 and 16 are a pair of first flaps, each comprising a bottom panel 22 and a divider panel 24. The bottom panels are hinged at 26 to the bottom edges of the side walls. The divider panels are hinged to the bottom panels at 28 on their edges opposite the edges attached to the sidewalls.

Each first flap has a slit 30 therein, preferably centrally located longitudinally in the flap and extending perpendicularly from side wall hinge 26 to a point spaced apart from the outside edge 32 of divider panel 24. Panel segments are formed on both sides of the slit, and the segments are joined at the outer edge of the flap by a bridge 34.

Each first flap also includes, on the outside edge 32 of divider panel 24, a locking slot 36. The locking slot is substantially colinear with slit 30, but still leaves a substantial bridge 34.

A pair of second flaps, each comprising a bottom panel 38 and a divider panel 40 are attached to the bottom edge of non-adjacent side walls, alternating with the first flaps. They are preferably attached to long side walls 14 and 18. The bottom panels are hinged at 42 to the side walls. Each bottom panel 38 is preferably configured and dimensioned to cover substantially half of the bottom of the carton in its folded condition. The divider panels are hinged to the bottom panels at 43 on their edges opposite the edges attached to the side walls.

Each second flap has at least one notch 44 in the outer edge 46 of its divider panel 40. Preferably two notches are provided, one on each side of center.

Each notch is configured to receive the bridge 34 of an associated divider panel 24 of one of the first flaps when the box is in its folded condition. The notches are spaced from the sides of divider panel 40 a distance substantially equal to the width of bottom panel 22 of the first flaps between hinge lines 26 and 28.

On one side of each notch 44 a locking tab 48 extends partially over the notch. The locking tab is configured to be engageable in locking slot 36 of one of the first flaps.

Opposite locking tabs 48 the edges of notches 44 of the second flaps are rounded to provide guide surfaces 50 to facilitate folding the first flaps into position.

The top of the carton may be provided with any suitable closure, such as conventional top flaps 52, 54, 56, and 58.

Preferably the various panels of the carton are configured to fold to form six cells of substantially similar dimensions. The divider panels preferably extend the full depth of the carton, providing complete partitions between the cells.

OPERATION

Figure 2:
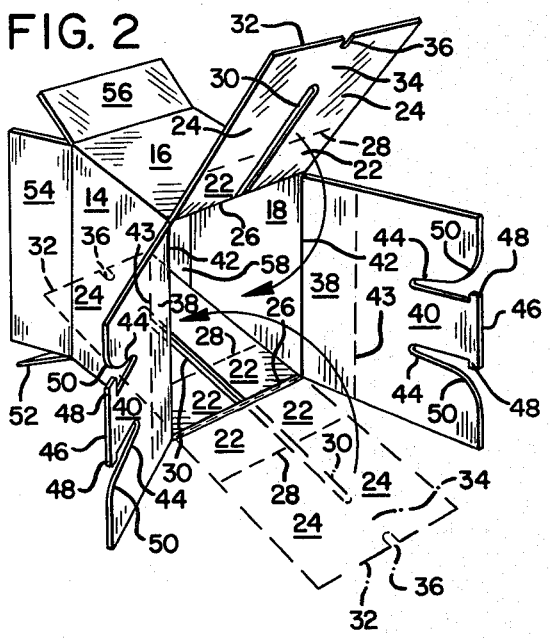
FIG. 2 is a top perspective view of the carton of FIG. 1 illustrating the step of folding the first set of flaps into the carton.

As shown in FIG. 1, to fold or set up the carton of the present invention side walls 12, 14, 16 and 18 are first squared to form a rectangular, tubular body. Then, as shown by the arrows in FIG. 2, the first flaps are folded into the carton, with both bottom panels 22 and divider panels 24 flat against the side walls.

Figure 3:
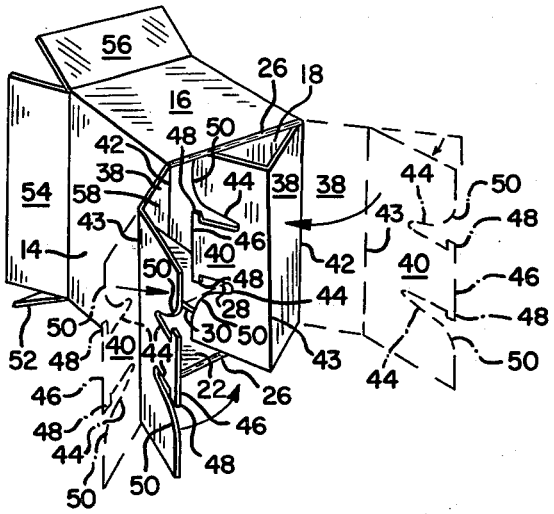
FIG. 3 is a top perspective view of the carton of FIG. 2 illustrating the step of folding the second set of flaps into the carton.
Figure 4:
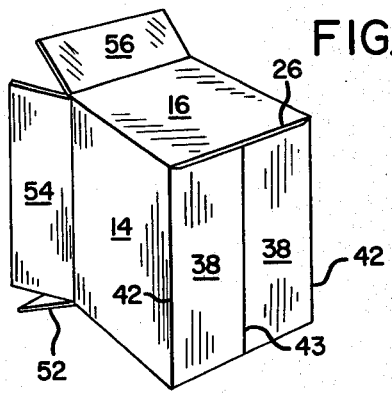
FIG. 4 is a top perspective view of the carton of FIG. 3 showing the finished bottom thereof.

FIG. 3 illustrates the next step of folding the second flaps and inserting them into the carton. As shown by the arrows, bottom panels 38 are positioned perpendicular to side walls 12, 14, 16 and 18, and the divider panels 40 are extended up centrally through the carton. After folding the second flaps into position the configuration of the bottom of the carton appears as shown in FIG. 4.

Figure 5:
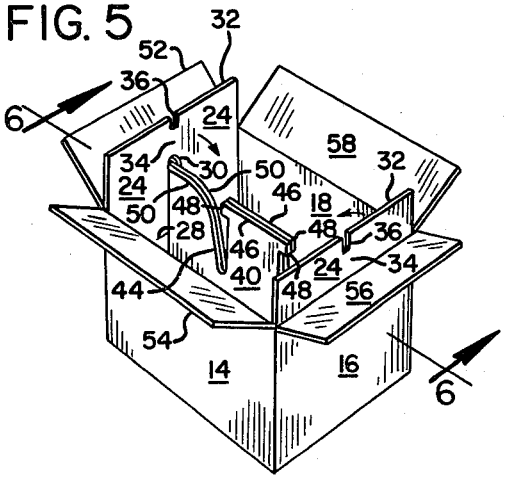
FIG. 5 is a top perspective view of the carton of FIG. 4 sitting on its bottom and illustrating the step of folding the first flaps into locking position with respect to the second flaps.
Figure 6:
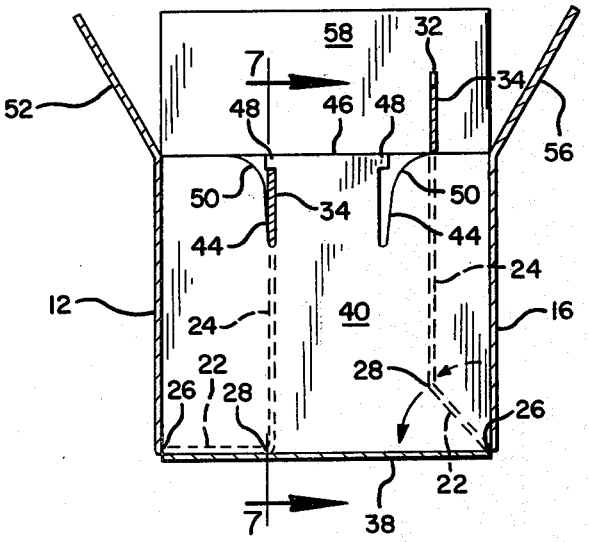
FIG. 6 is a longitudinal section taken along the line 6—6 of FIG. 5.

Next the divider panels 24 of the first flaps are folded down into the carton as shown by the arrows in FIGS. 5 and 6. Bridges 34 are directed by guiding surfaces 50 to fit into notches 44. When the divider panels 24 and 40 are fully engaged, locking tabs 48 fit into locking slots 36 securing the bottom of the carton. FIGS. 7 and 9 illustrate more clearly this locking arrangement.

FIG. 8 shows the completed carton of the present invention. It is evident that by filling the carton with bottles or the like that the lock formed by locking tabs 48 engaging locking slots 36 is further secured since the divider panels 24 cannot then move sideways to release from the locking tabs.

With the carton of the present design stacking strength and carton stability is substantially increased because of the interlocked relationship and the bearing provided by full-length divider panels 24 and 40. In fact, typical cartons embodying my new design have stacking strengths approximately 28% greater than cartons with no dividers, whereas typical cartons fitted with conventional H-pad style dividers have stacking strengths only about 10% greater than dividerless cartons. Also, since the divider panels extend the full depth of the carton protection of the articles in their individual cells is complete.

Having described the preferred embodiment of my invention, I claim:

1. A multicompartment folding carton comprising:

(a) four articulated side walls;

(b) a pair of foldable, opposed first flaps, each having a bottom panel and a divider panel, the bottom panel being hinged to one of the side walls and the divider panel being hinged to the bottom panel on its edge opposite the edge attached to the side wall, and each first flap having a central slit therein extending substantially from its side wall hinge, substantially perpendiculary thereto, to a point spaced apart from the outer edge of the divider panel forming panel segments on both sides of the slit and having a bridge between the segments; and (c) a pair of foldable, opposed second flaps, each having a bottom panel and a divider panel, the bottom panel being hinged to one of the side walls and the divider panel being hinged to the bottom panel on its edge opposite the edge attached to the side wall, the bottom panel of each second flap in its folded condition covering substantially half of the bottom of the carton, each second flap having a notch therein on its outer edge configured to receive the bridge of the divider panel of one of the first flaps in its folded condition.

2. The carton of claim 1 wherein each first flap further has a locking slot therein, on the outside edge thereof, substantially colinear with the slit, and wherein each second flap further comprises a locking tab extending partially over the notch therein, and engageable in the locking slot of one of the first flaps.

3. The carton of claim 2 wherein the second flaps are rounded at the edges of the notches opposite the locking tabs thereby providing guide surfaces to facilitate folding the first flaps into position.

4. The carton of claim 1 wherein of the squared articulated side walls two opposed side walls are long side walls and the other two opposed side walls are short side walls, and wherein the first flaps are attached to the short side walls and the second flaps are attached to the long side walls.

5. The multicompartment carton of claim 1 wherein six cells of substantially similar configuration and dimension are formed by the divider panels.

6. A multicompartment folding carton comprising:

(a) four articulated side walls;

(b) a pair of foldable, opposed first flaps each having a bottom panel and a divider panel, the bottom panel being hinged to one of the side walls and the divider panel being hinged to the bottom panel on its edge opposite the edge attached to the side wall, and each first flap having a slit therein extending substantially from its side wall hinge, substantially perpendicularly thereto, to a point spaced apart from the outer edge of the divider panel forming panel segments on both sides of the slit and having a bridge between the segments, and having also a locking slot therein on the outside edge of the divider panel substantially colinear with the slit; and (c) a pair of foldable opposed second flaps, each having a bottom panel and a divider panel, the bottom panel being hinged to one of the side walls and the divider panel being hinged to the bottom panel on its edge opposite the edge attached to the side wall, each second flap having a notch therein on its outer edge configured to receive the bridge of the divider panel of one of the first flaps in its folded condition, and a locking tab extending partially over the notch and engageable in the locking slot of one of the first flaps.

7. A blank for a substantially rectangular multicompartment folding carton comprising:

(a) four articulated side walls and a glue flap hinged to one end of the side walls for lapping attachment to the other end of the side walls;

(b) a pair of first flaps, one attached to the bottom edge of one side wall and the other to the bottom edge of the non-adjacent side wall, each first flap having a bottom panel and a divider panel, the bottom panel being hinged to the side wall and the divider panel being hinged to the bottom panel on its edge opposite the edge attached to the side wall, and each first flap having a slit therein extending substantially from its side wall hinge, substantially perpendicularly thereto, to a point spaced apart from the outer edge of the divider panel forming panel segments on both sides of the slit and having a bridge between the segments, and having a locking slot therein on the outside edge of the divider panel substantially colinear with the slit; and (c) a pair of second flaps, each attached to the bottom edge of a non-adjacent side wall, alternating with the first flaps, each second flap having a bottom panel and a divider panel, the bottom panel being hinged to the side wall and the divider panel being hinged to the bottom panel on its edge opposite the edge attached to the side wall, each second flap having a notch therein on its outer edge configured to receive the bridge of the divider panel of one of the first flaps in its folded condition, and a locking tab extending partially over the notch and engageable in the locking slot of one of the first flaps.

* * * * *